US008955700B2

(12) United States Patent
Barber et al.

(10) Patent No.: US 8,955,700 B2
(45) Date of Patent: Feb. 17, 2015

(54) PORTABLE ON-TREAD TIRE RACK

(75) Inventors: Scott Barber, Cleveland, OH (US); Mark King, Copley, OH (US); David Shaffstall, Denver, CO (US)

(73) Assignee: Dealer Tire, LLC, Cleveland, OH (US)

( * ) Notice: Subject to any disclaimer, the term of this patent is extended or adjusted under 35 U.S.C. 154(b) by 0 days.

(21) Appl. No.: 13/248,623

(22) Filed: Sep. 29, 2011

(65) Prior Publication Data

US 2012/0074084 A1 Mar. 29, 2012

Related U.S. Application Data

(60) Provisional application No. 61/387,694, filed on Sep. 29, 2010.

(51) Int. Cl.

| | |
|---|---|
| ***A47B 43/00*** | (2006.01) |
| *A47B 47/00* | (2006.01) |
| *A47F 7/04* | (2006.01) |

(52) U.S. Cl.

CPC ..... *A47F 7/04* (2013.01)
USPC ..... 211/195; 211/194; 211/23

(58) Field of Classification Search

CPC ..... A47B 43/00; A47F 7/04
USPC ..... 211/194, 195, 189, 20, 21, 23, 24, 38, 211/85, 132.1, 133.1, 133.3, 167
See application file for complete search history.

(56) References Cited

U.S. PATENT DOCUMENTS

| | | | | |
|---|---|---|---|---|
| 1,015,182 | A * | 1/1912 | Herbin | 108/163 |
| 1,099,849 | A * | 6/1914 | Hammond | 108/60 |
| 1,198,431 | A * | 9/1916 | Forsyth | 108/163 |
| 2,403,324 | A * | 7/1946 | Anderson | 69/19 |
| 2,679,321 | A * | 5/1954 | Koeferl | 211/50 |
| 2,699,911 | A * | 1/1955 | Chase et al. | 108/53.5 |
| 2,956,763 | A * | 10/1960 | D'Arca | 108/53.1 |

(Continued)

FOREIGN PATENT DOCUMENTS

| | | |
|---|---|---|
| JP | 7-21587 | 4/1995 |
| JP | 2546543 | 8/1996 |

(Continued)

OTHER PUBLICATIONS

Written Opinion and International Search Report, Corresponding PCT Application No. PCT/US2011/053910 filed Aug. 29, 2011; Authorized Officer Kim, Jin Ho; dated Apr. 23, 2012.

*Primary Examiner* — Joshua J Michener
*Assistant Examiner* — Devin Barnett
(74) *Attorney, Agent, or Firm* — Benesch, Friedlander & Coplan & Aronoff, LLP

(57) ABSTRACT

A tire rack includes a base having a plurality of apertures in a bottom surface, and a plurality of posts extending from a top surface of the base. Each of the plurality of posts has a reduced diameter portion having dimensions corresponding to the apertures in the bottom surface of the base. The tire rack further includes a plurality of side bars. Each side bar extending between two of the plurality of posts, and each side bar having a plurality of apertures. The tire rack also has a plurality of crossbars. Each crossbar extends between two of the plurality of side bars, wherein each crossbar has a first end removably received in an aperture of a first side bar and a second end removably received in an aperture of a second side bar. The plurality of crossbars are configured to receive a plurality of tires in an upright position.

14 Claims, 14 Drawing Sheets

(56) References Cited

U.S. PATENT DOCUMENTS

| | | | | |
|---|---|---|---|---|
| 3,322,286 | A * | 5/1967 | Sylvester | 211/24 |
| 3,499,398 | A * | 3/1970 | Murray | 108/53.5 |
| 3,557,966 | A * | 1/1971 | Skubic | 211/24 |
| 3,606,023 | A * | 9/1971 | Edmunds | 211/74 |
| 3,665,869 | A * | 5/1972 | Howe | 108/53.1 |
| 5,141,114 | A * | 8/1992 | Cate et al. | 211/85.8 |
| 5,228,821 | A * | 7/1993 | Gleffe et al. | 414/403 |
| 5,692,625 | A * | 12/1997 | Filipescu et al. | 211/195 |
| 5,718,441 | A * | 2/1998 | Kern et al. | 280/79.3 |
| 5,833,074 | A * | 11/1998 | Phillips | 211/21 |
| 5,924,577 | A * | 7/1999 | Gessert | 211/41.1 |
| 6,279,763 | B1 * | 8/2001 | Bush | 211/195 |
| 7,044,065 | B2 * | 5/2006 | Arai et al. | 108/53.1 |
| 7,178,680 | B2 * | 2/2007 | Botner | 211/34 |
| 7,270,236 | B2 * | 9/2007 | Angeletti et al. | 206/448 |
| 7,802,526 | B2 * | 9/2010 | Brady et al. | 108/53.5 |
| 8,002,128 | B2 * | 8/2011 | Kern et al. | 211/194 |
| 8,210,374 | B2 * | 7/2012 | Harpole | 211/195 |
| 8,244,400 | B2 * | 8/2012 | Cottone et al. | 700/217 |
| 2002/0088766 | A1 * | 7/2002 | Flores | 211/194 |
| 2004/0020887 | A1 * | 2/2004 | Jersey et al. | 211/189 |
| 2006/0091096 | A1 * | 5/2006 | Velez et al. | 211/194 |
| 2008/0217276 | A1 * | 9/2008 | Brady et al. | 211/195 |
| 2008/0237168 | A1 * | 10/2008 | Harpole | 211/195 |
| 2009/0120887 | A1 * | 5/2009 | Meehan | 211/85.8 |
| 2011/0180505 | A1 * | 7/2011 | Noniewicz et al. | 211/195 |
| 2011/0253656 | A1 * | 10/2011 | Vermeer | 211/85.8 |
| 2013/0001179 | A1 * | 1/2013 | Harpole | 211/59.4 |

FOREIGN PATENT DOCUMENTS

| | | |
|---|---|---|
| JP | 10166805 | 6/1998 |
| JP | 10226406 | 8/1998 |
| JP | 200041804 | 2/2000 |

* cited by examiner

PORTABLE ON-TREAD TIRE RACK

FIELD OF INVENTION

The present application relates to the field of tire storage. More particularly, the present application relates to a portable tire rack.

BACKGROUND

Currently, when tires are stored in large volumes, such as in a warehouse, they are stored on tire racks or general purpose racks. Such racks may be anchored to the floor or a wall, and are known to be as high as 16 feet and hold six stacked rows of tires. To transport tires from a large volume storage area, the tires are removed from the rack and placed on a shipping pallet. Alternatively, tires may be placed in shipping racks. Known shipping racks hold two stacked rows of tires.

SUMMARY OF THE INVENTION

In one embodiment, a tire rack includes a base having a plurality of apertures in a bottom surface, and a plurality of posts extending from a top surface of the base. Each of the plurality of posts has a reduced diameter portion having dimensions corresponding to the apertures in the bottom surface of the base. The tire rack further includes a plurality of side bars. Each side bar extending between two of the plurality of posts, and each side bar having a plurality of apertures. The tire rack also has a plurality of crossbars. Each crossbar extends between two of the plurality of side bars, wherein each crossbar has a first end removably received in an aperture of a first side bar and a second end removably received in an aperture of a second side bar. The plurality of crossbars are configured to receive a plurality of tires in an upright position.

In another embodiment, a tire rack system includes a first base, and a first plurality of posts extending from a top surface of the first base, where each of the plurality of posts having a reduced diameter portion. The tire rack system also includes a second base having a plurality of apertures in a bottom surface that removably receive the reduced diameter portions of the first plurality of posts. A second plurality of posts extend from a top surface of the second base. The tire rack system also includes a plurality of side bars, with each side bar extending between two of the plurality of posts, and each side bar having a plurality of apertures. The system also has plurality of crossbars, with each crossbar extending between two of the plurality of side bars. Each crossbar has a first end removably received in an aperture of a first side bar and a second end removably received in an aperture of a second side bar. The plurality of crossbars are configured to receive a plurality of tires in an upright position.

In yet another embodiment, an insert is provided for a rack system having at least a pair of front posts, a pair of rear posts, a plurality of front elongated crossbars extending between the pair of front posts, and a pair of rear elongated crossbars extending between the pair of rears posts. The insert includes a pair of opposing side beams. Each side beam has a front, inverted stair-shaped abutment and a rear, inverted stair-shaped abutment. The insert also includes a pair of elongated crossbeams extending between the opposing side beams.

BRIEF DESCRIPTION OF THE DRAWINGS

In the accompanying drawings, structures are illustrated that, together with the detailed description provided below, describe exemplary embodiments of the claimed invention.

In the drawings and description that follows, like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 2:
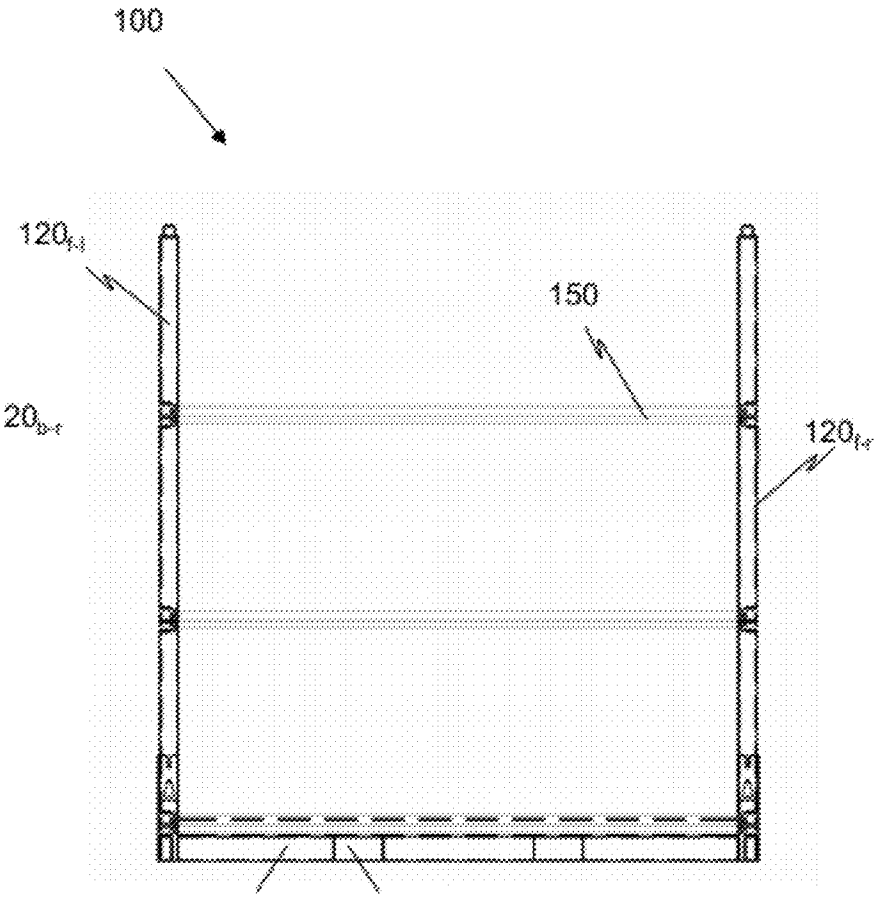
FIG. 2 illustrates a front view of the tire rack 100.
Figure 1:
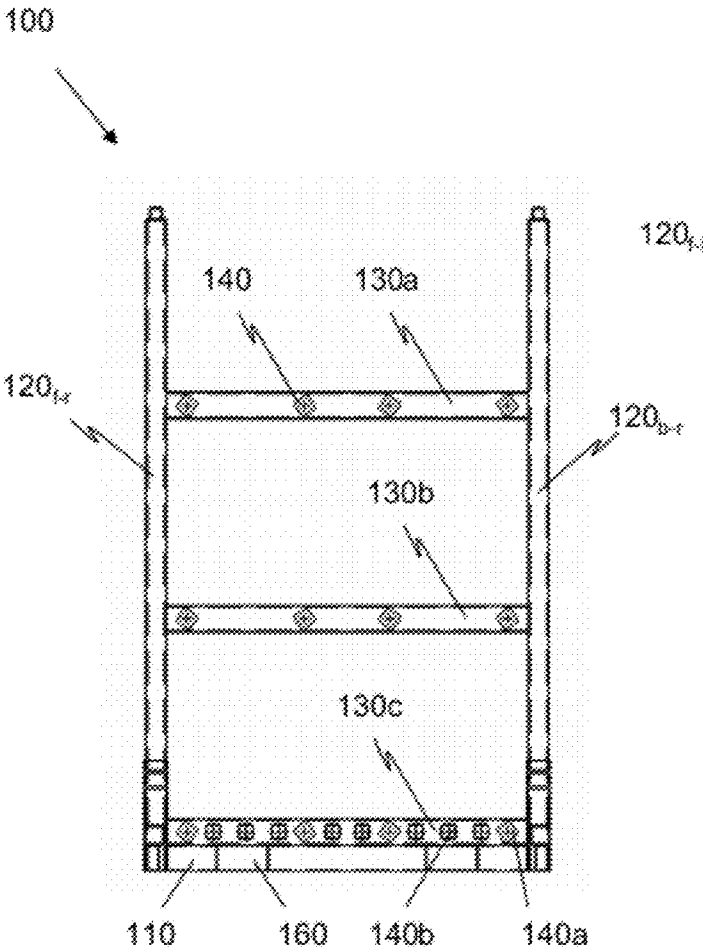
FIG. 1 illustrates a side view of one embodiment of a tire rack 100.

FIGS. 1 and 2 illustrate a side view and front view, respectively, of one embodiment of a tire rack 100. The tire rack 100 includes a rectangular base 110 having a plurality of posts 120 extending therefrom. In the illustrated embodiment, the tire rack 100 has four posts 120, including a front right post $\mathbf{120}_{f\text{-}r}$ extending from a front right corner of the base 110, a back right post $\mathbf{120}_{b\text{-}r}$ extending from a back right corner of the base 110, a front left post $\mathbf{120}_{f\text{-}l}$ extending from a front left corner of the base 110, and a back left post (not shown) extending from a back left corner of the base 110. It should be understood that in alternative embodiments, the base may be square, circular, oval-shaped, or have any geometric shape. Further, in other alternative embodiments, additional posts may also be employed. For example, a front center post, a rear center post, or a central post may be employed.

The tire rack 100 further includes a plurality of side bars 130. In the illustrated embodiment, the tire rack has three side bars 130 on each side, including a top right side bar 130*a* extending from the front right post $\mathbf{120}_{f\text{-}r}$ to the back right post $\mathbf{120}_{b\text{-}r}$, a middle right side bar 130*b* extending from the front right post $\mathbf{120}_{f\text{-}r}$ to the back right post $\mathbf{120}_{b\text{-}r}$ below the top right side bar 130*a*, and a lower right side bar 130*c* extending from the front right post $\mathbf{120}_{f\text{-}r}$ to the back right post $\mathbf{120}_{b\text{-}r}$ below the middle right side bar 130*a*. Similarly, the left side includes a top left side bar (not shown), a middle left side bar (not shown), and a lower left side bar (not shown) at elevations corresponding to the side bars on the right side. In alternative embodiments, any number of side bars may be employed.

In one embodiment, the side bars 130 are permanently affixed to the posts 120 by welding, epoxy or other adhesives, or by fasteners, such as bolts, screws, pins, nails, and other known fasteners. In an alternative embodiment, the side bars 130 are removably connected to the posts 120.

Each side bar 130 includes a plurality of apertures 140. In the illustrated embodiment, the top right side bar 130*a* and the middle right side bar 130*b* each have four square-shaped apertures 140. The bottom right side bar 130*c* has 12 square-shaped apertures 140, including four primary apertures 140*a* and eight secondary apertures 140*b*. It should be understood that the side bars on the left side have apertures in corresponding positions and orientations. In an alternative embodiment (not shown), the top right side bar and the middle right side bar each have two square-shaped apertures and the bottom right side bar has six square-shaped apertures, including two primary apertures and four secondary apertures. In other alternative embodiments (not shown), each side bar may include any number of apertures. In still other alternative embodiments (not shown), the apertures may be rectangular, circular, oval-shaped, or any other geometric shape.

The apertures 140 are dimensioned to removably receive crossbars 150 that extend lengthwise across the base 110. The apertures 140 of the top and middle side bars 130*a,b* and the primary apertures 140*a* of the bottom side bars 130*c* are angled and positioned such that the crossbars 150 are oriented to receive a plurality of tires. The secondary apertures 140*b* of the bottom side bars 130*c* may be in any position and orientation.

The base 110 also includes a plurality of apertures 160 in both the front, back and sides. In one embodiment, the apertures 160 of the base 110 are sized and positioned to receive a fork of a forklift.

In one embodiment, the base 110, posts 120, side bars 130 and crossbars 150 are all constructed of carbon steel. In alternative embodiments, one or more of these components are constructed of stainless steel, aluminum, iron, other metals or alloys, or a polymeric material.

In one embodiment, the apertures 140 in the side bars 130 and the apertures 160 in the base 110 are laser-cut. In an alternative embodiment, the apertures may be punched, saw-cut, flame-cut, plasma-cut or molded.

Figure 4:
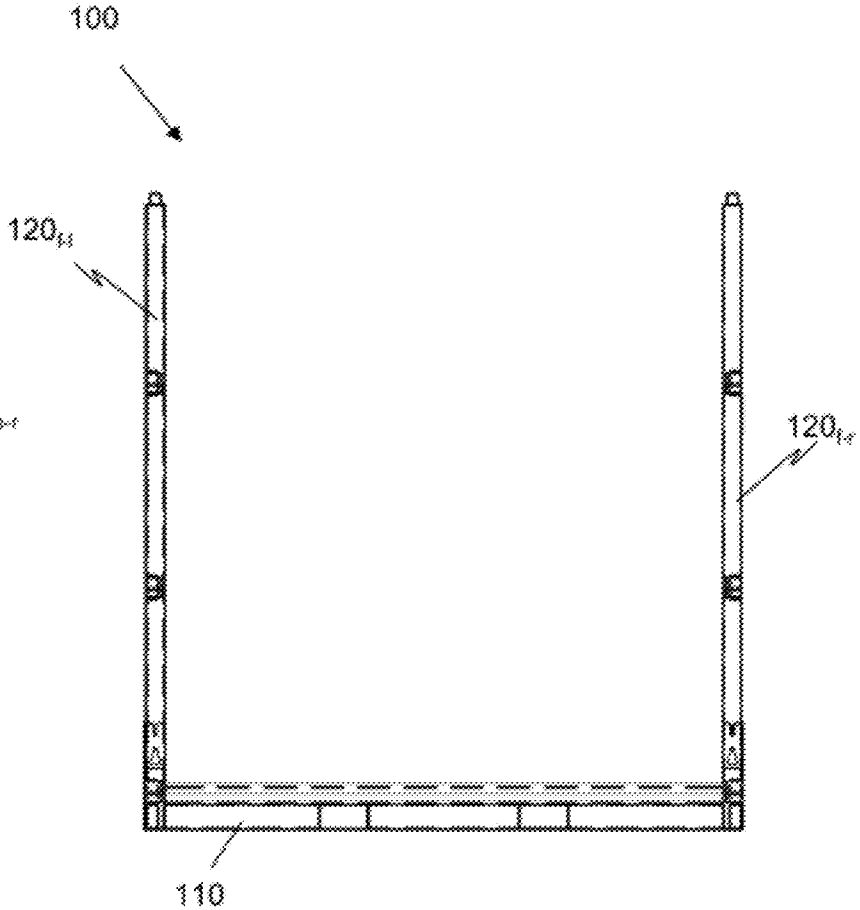
FIG. 4 illustrates a front view of the tire rack 100 with certain cross-bars removed.
Figure 3:
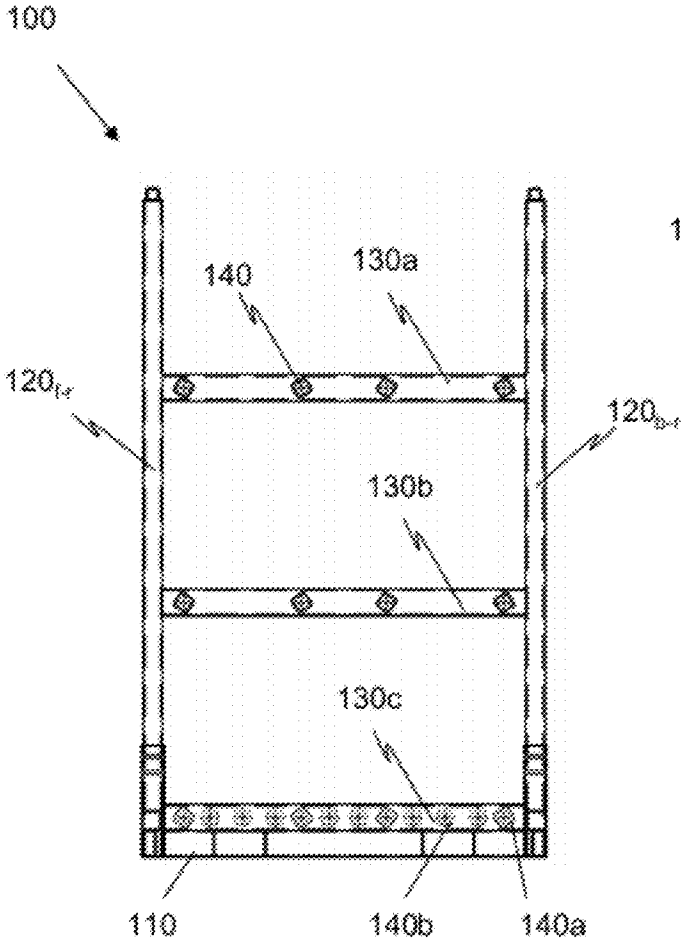
FIG. 3 illustrates a side view of the tire rack 100 with certain cross-bars removed.

FIGS. 3 and 4 illustrate side and front views, respectively, of the tire rack 100 with crossbars 150 removed from the apertures 140 of the upper and middle side bars 130. After these crossbars 150 are removed, they may be received in the secondary apertures 140*b* of the bottom side bars 130*c*. In one embodiment, the crossbars 150 in the primary apertures 140*a* of the bottom side bars 130*c* are removable. In an alternative embodiment, the crossbars 150 in the primary apertures 140*a* may be permanently affixed by welding, epoxy or other adhesives, or by fasteners, such as bolts, screws, pins, nails, and other known fasteners.

Figure 5:
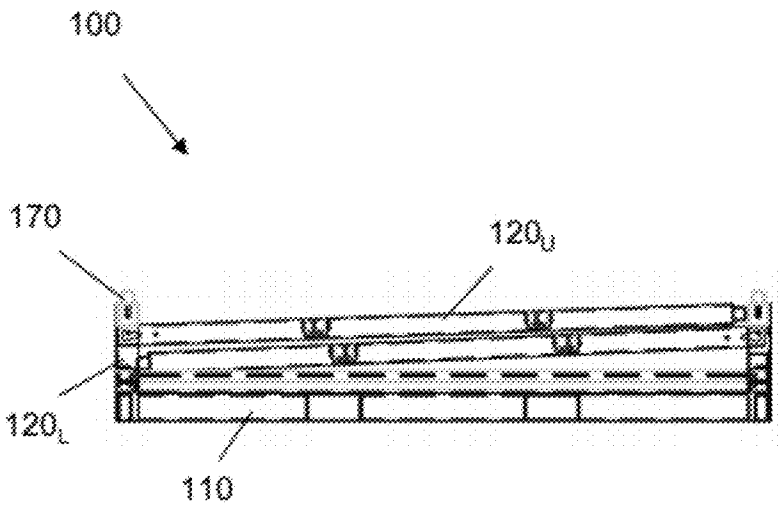
FIG. 5 illustrates a front view of the tire rack 100 with certain cross-bars removed, and posts placed in a downward position.

FIG. 5 illustrates a front view of the tire rack 110 with the posts 120 in a downward position. Each post 120 includes an upper portion $\mathbf{120}_U$ hingedly connected to a lower portion $\mathbf{120}_L$. In the illustrated embodiment, the lower portions $\mathbf{120}_L$ are permanently affixed to the base by welding, epoxy or other adhesives, or by fasteners, such as bolts, screws, pins, nails, and other known fasteners.

After the crossbars 150 are removed from the upper and middle side bars 130*a,b* and placed in the secondary apertures 140*b* of the lower side bar, the upper portions $\mathbf{120}_U$ of the posts 120 are folded down lengthwise. In one embodiment, the hinged connection between the upper portion $\mathbf{120}_U$ and the lower portion $\mathbf{120}_U$ includes a locking mechanism (not shown) to lock the posts 120 in one of an upright position (as shown in FIGS. 1-4) and a downward position (as shown in FIG. 5). In an alternative embodiment (not shown), the posts 120 do not include a hinged connection, but instead are removable from the base 110.

Figure 6:
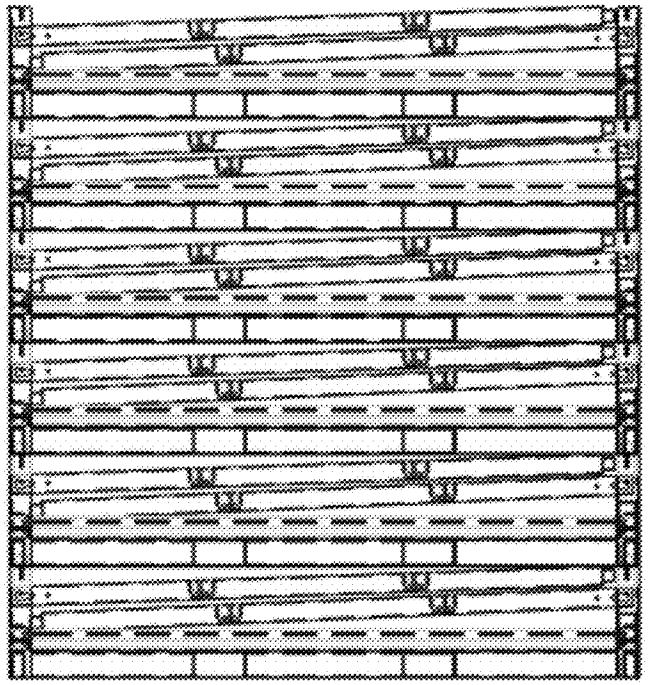
FIG. 6 illustrates a front view of a plurality of stacked tire racks with cross-bars removed, and posts placed in a downward position.

After the posts 120 are placed in a downward position, stack posts 170 may be removably attached to the lower portions $\mathbf{120}_L$. In the illustrated embodiment, the stack posts 170 are dimensioned to be received in apertures of a base of another tire rack, such that a plurality of tire racks may be stacked as shown in FIG. 6. It may be desirable to stack tire racks in this manner for storage or shipping to reduce transportation costs for initial deliveries.

When it is desired to use the tire racks 110, they may then be unstacked. The stack posts 170 are removed and the posts 120 are moved to the upright position. The crossbars 150 are then removed from the secondary apertures 140*b* of the lower side bar and placed back in the upper and middle side bars 130*a,b*. The tire rack 110 is then ready to receive tires.

In an alternative embodiment (not shown), the posts are unitary, and do not include separate upper and lower portions. Instead, the entire post is permanently affixed to the base by welding, epoxy or other adhesives, or by fasteners, such as bolts, screws, pins, nails, and other known fasteners. Likewise, the crossbars may also be permanently affixed to the side bars by welding, epoxy or other adhesives, or by fasteners, such as bolts, screws, pins, nails, and other known fasteners. In such an embodiment, the tire rack would not be stackable in the manner shown in FIG. 6.

Figure 7:
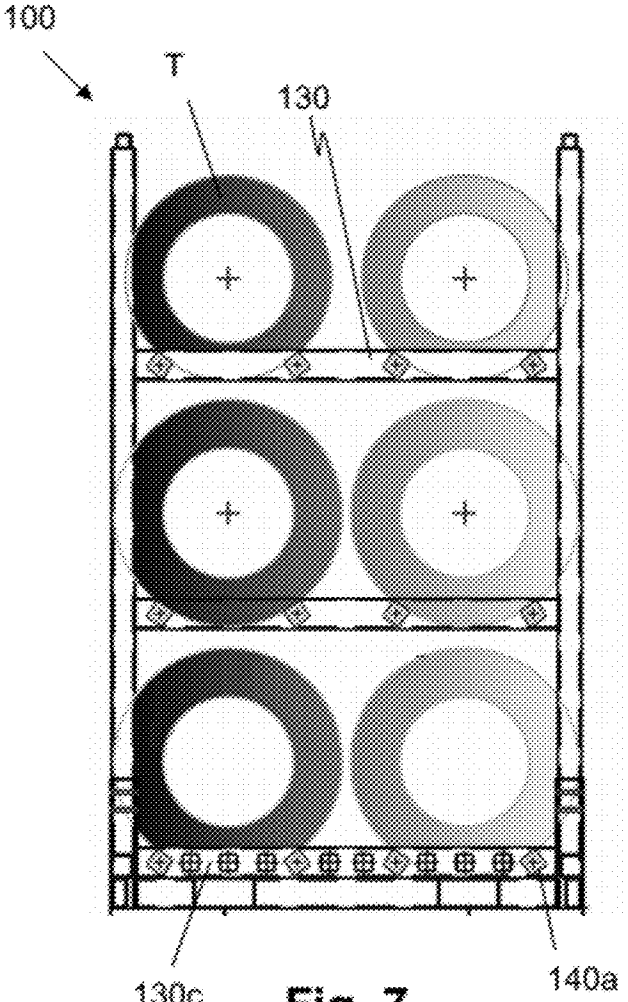
FIG. 7 illustrates a side view of one embodiment of the tire rack 100 with tires.
Figure 8:
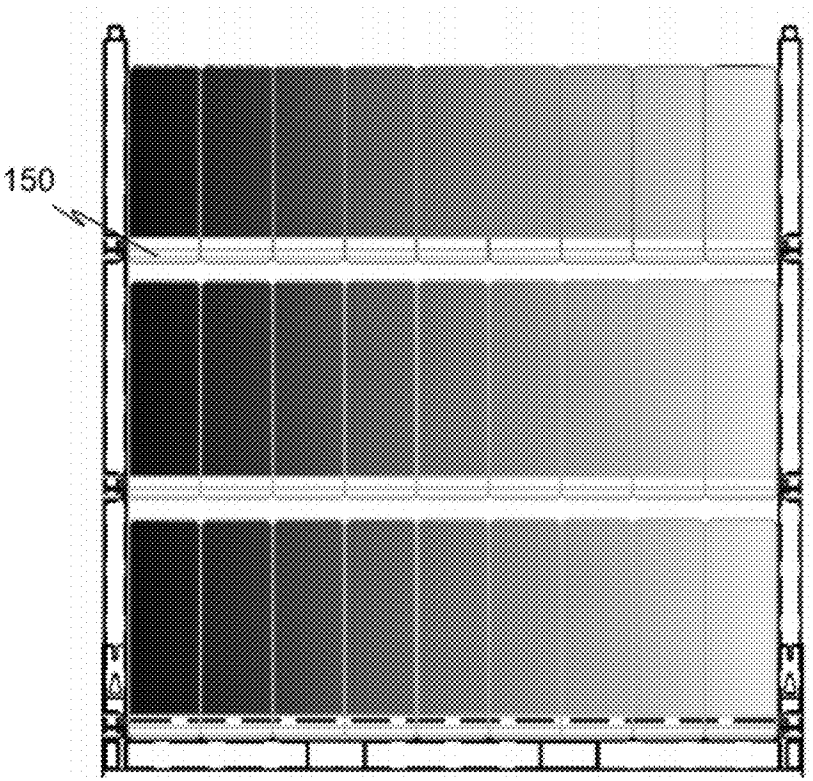
FIG. 8 illustrates a front view of one embodiment of the tire rack 100 with tires.

FIGS. 7 and 8 illustrate side and front views, respectively, of the tire rack 100 holding a plurality of tires T. Each tire T may be a loose tire or a tire and wheel assembly. Where tire and wheel assemblies are held, the tire may be inflated or un-inflated.

In the illustrated embodiment, each side bar 130 supports four crossbars 150 arranged to hold two rows of tires T. Accordingly, the tire holds six rows of tires T. In an alternative embodiment (not shown), additional crossbars are employed to provide additional support for the tires. In another alternative embodiment (not shown), each side bar supports two crossbars arranged to hold a single row of tires. Such an embodiment would hold three rows of tires.

In the illustrated embodiment, the tire rack 100 is dimensioned to hold nine tires T in each row. Accordingly, the tire rack 100 has a capacity of 54 tires T. In alternative embodiments (not shown), the tire rack may be dimensioned to hold a greater or lesser number of tires.

In one specific embodiment, the tire rack 100 is 102 inches (2.6 meters) tall, 96 inches (2.4 meters) wide, and 62 inches (1.6 meters) deep. The base 110 has a height of 4 inches (10 centimeters) and may be referred to as a "low profile base." The lower side bar 130*c* and its primary apertures 140*a* are positioned such that the lowest point of the primary apertures is 0.75 inches (19 millimeters) above the base 110. The primary apertures 140*a* are further positioned such that the lowest point of a 30-inch (76-centimeter) diameter tire held by the lower crossbars 150 would be 0.25 inches (6 millimeters) above the top of the base 110. It should be understood, however, that this specified embodiment is merely exemplary, and that any dimensions may be selected as desired.

Figure 9:
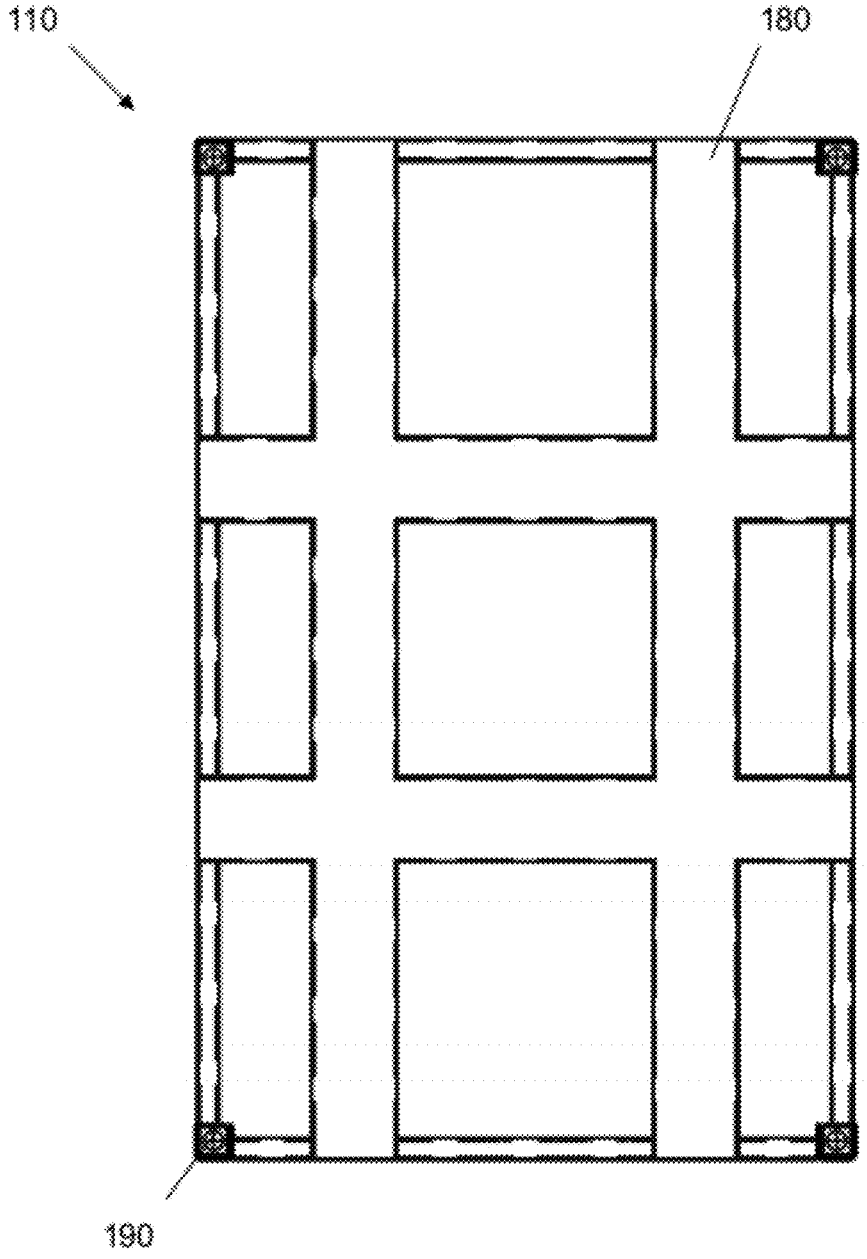
FIG. 9 illustrates a bottom view of the tire rack 100, without the side members and cross members.

FIG. 9 illustrates a bottom view of the base 110 of the tire rack 100. As can be seen from this view, the apertures 160 of the base define pockets 180 on each side of the base 110. Each pocket 180 extends along the entire length (or width) of the base 110. In alternative embodiments, the pockets 180 extend along only a portion of the length (or width) of the base 110.

In one embodiment, the pockets 180 are dimensioned to receive a fork of a forklift. In one specific embodiment, the centerlines of each pocket 180 on a given side are spaced apart by a distance of 32 inches (81 centimeters). In alternative embodiments, the pockets may be spaced by any distance. In another alternative embodiment, the pockets may be omitted.

With continued reference to FIG. 9, the bottom of the base 110 further includes a plurality of bottom apertures 190. In one embodiment, each bottom aperture 190 is dimensioned to receive a portion of a post from another tire rack. In the illustrated embodiment, the base 110 includes four apertures 190, each being located at a corner of the rectangular shaped base 110. In alternative embodiments, any number of bottom apertures 190 may be employed at any location.

Figure 10:
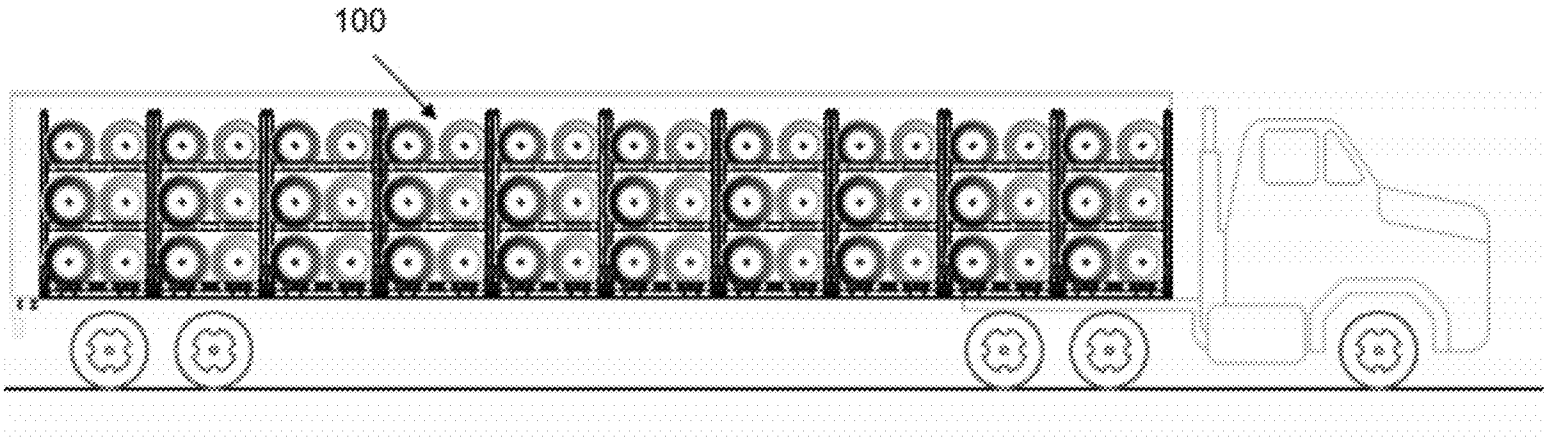
FIG. 10 illustrates a partial cross-section of an exemplary truck, carrying a plurality of tire racks with tires.

FIG. 10 illustrates a plurality of tire racks 100 disposed in a trailer of a truck. In one embodiment, the dimensions of the tire racks 100 is selected such that a tire rack holding three levels of tires can be received in a selected trailer of a truck. In the illustrated embodiment, each tire rack 100 holds three levels of tires, with each level accommodating two rows of tires, and the tire racks 100 are dimensioned such that 10 tire racks can be received in a selected trailer of a truck.

In one embodiment, the tire racks 100 may be loaded into and unloaded out of a trailer of a truck with a forklift, by inserting the forks of the forklift into the pockets of the base 110. The tire racks 100 may be loaded into and unloaded out of a trailer of a truck while they are holding a plurality of tires T. In other words, it is not necessary to remove the tires T from the racks 100 for loading or unloading purposes.

Figure 11:
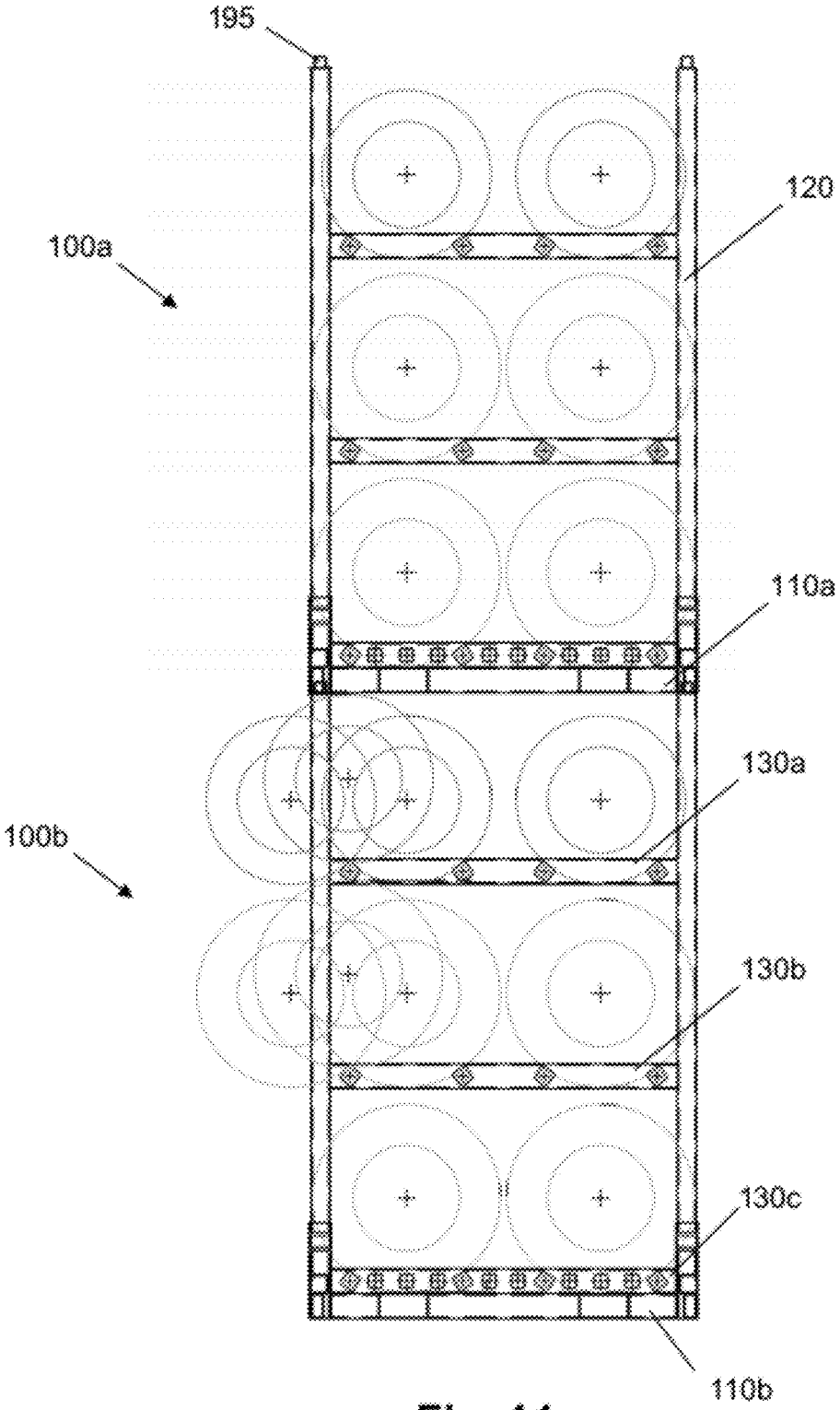
FIG. 11 illustrates a side view of one embodiment of two stacked tire racks with tires.

FIG. 11 illustrates a side view of a first tire rack 100*a* stacked on top of a second tire rack 100*b*. In the illustrated embodiment, the top of each post 120 of a tire rack 100 has a reduced dimension portion 195 that is dimensioned to be received in a bottom aperture 190 of a base 110 of another tire rack 100.

In one embodiment, the lower side bars 130*c*, primary apertures 140*a*, and associated crossbars 150 are positioned such that they may hold 30-inch (76-centimeter) diameter tires such that the bottom of each tire is 0.13 inches (3 millimeters) above the top of the base 110. Further, the middle side bars 130*b* and associated apertures 140 and crossbars 150 are positioned such that, when a 30-inch (76-centimeter) diameter tire is inserted into the crossbars 150 associated with the lower sidebars 130*c*, the top of the tire clears the bottom of the crossbars 150 associated with the middle side bar 130*b* by 0.13 inches (3 millimeters). Additionally, the middle side bars 130*b* and associated apertures 140 and crossbars 150 are positioned such that such that they may hold 30-inch (76-centimeter) diameter tires. Further, the upper side bars 130*a* and associated apertures 140 and crossbars 150 are positioned such that, when a 30-inch (76-centimeter) diameter tire is inserted into the crossbars 150 associated with the middle sidebars 130*b*, the top of the tire clears the bottom of the crossbars 150 associated with the top side bar 130*a* by 0.13 inches (3 millimeters). Additionally, the top side bars 130*a* and associated apertures 140 and crossbars 150 are positioned such that such that they may hold 27-inch (69-centimeter) diameter tires. Further, the top side bars 130*a* and associated apertures 140 and crossbars 150 and the posts 120 and reduced dimension portions 195 are positioned such that, when a first tire rack 100*a* is stacked on a second tire rack 110*b*, when a 27-inch (69-centimeter) diameter tire is inserted into the crossbars 150 associated with the middle sidebars 130*b* of the second rack 100*b*, the top of the tire clears the bottom of the base 110*a* of the first rack 100*a* by 0.13 inches (3 millimeters). However, it should be understood that this embodiment is exemplary, and other dimensions and positions of components may be employed.

In one embodiment, the tire racks 100 may be stacked or unstacked with a forklift, by inserting the forks of the forklift into the pockets of the base 110. The tire racks 100 may be stacked or unstacked while they are holding a plurality of tires T. In other words, it is not necessary to remove the tires T from the racks 100 for stacking purposes.

Figure 12:
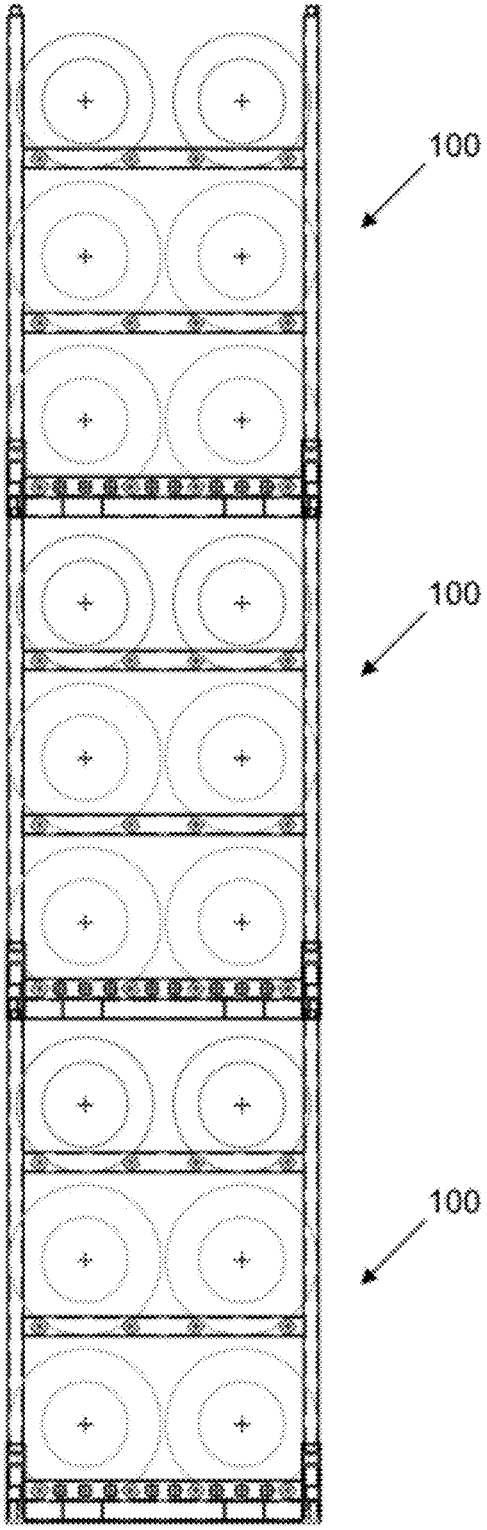
FIG. 12 illustrates a side view of one embodiment of three stacked tire racks with tires.

FIG. 12 illustrates a side view of three stacked tire racks 100. In one known embodiment, it is desired to stack three tire racks for storing tires in a storage location, such as a warehouse. In this embodiment, the total height of the three stacked tire racks 100 is 302.5 inches (7.7 meters). However, it should be understood that tire racks of different dimensions may be employed, and that a stack of three such racks would have a different height. Further, tire racks may be stacked according to available storage space. Therefore, it should be understood that in storage areas having a lower height, a single tire rack or a stack of two racks may be employed. Similarly, in storage areas having a higher height, four or more tire racks may be stacked. In all cases, the tire racks may be stacked or unstacked without removing the tires.

In one known embodiment, a rack or stacks of racks is mounted to a mounting plate. The mounting plate may be fixed to a floor surface, using known fixing means, such as bolts, screws, nails, pegs, adhesive, and welding. The mounting plate may have posts located in positions corresponding to the posts 120 of the rack 100 and dimensioned to be received in the bottom apertures 190 of the base 110.

In one known embodiment, at least one rack includes casters that extend from one or more posts at a position above the base. The casters may be configured to engage a caster from another rack. Alternatively, the casters may be configured to receive a crossbar that extends from one rack to another.

In one known embodiment, multiple stacks of three racks are disposed in a storage area. At least two of the storage racks are spaced apart by a distance of 84 inches (213 centimeters) to allow a user or a device clearance for removing a tire from a rack or placing a tire in the rack.

Figure 14:
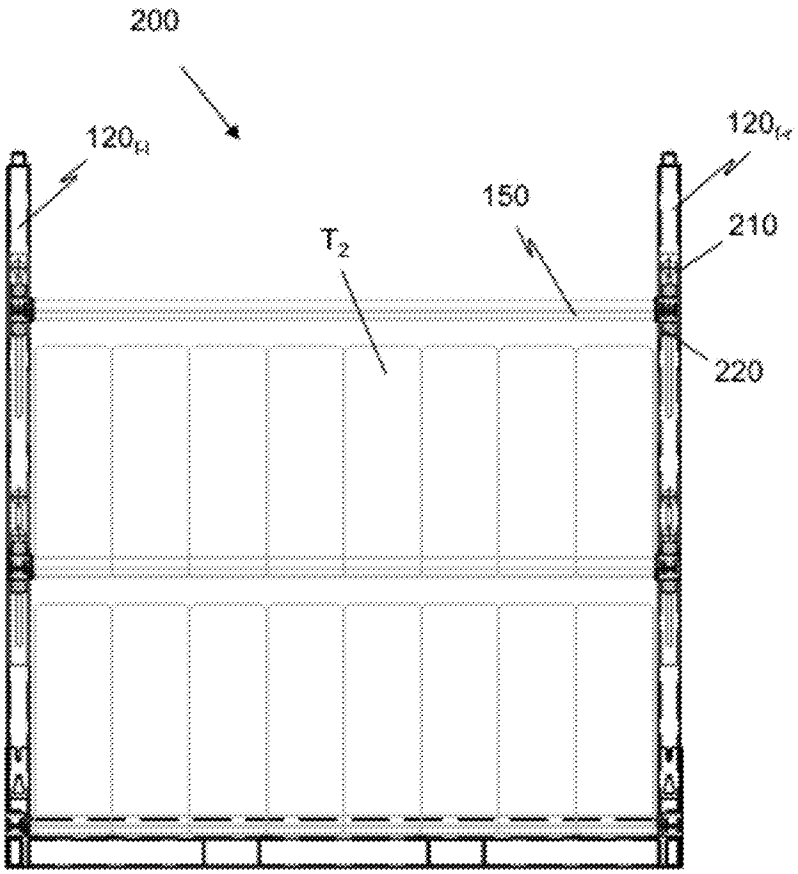
FIG. 14 illustrates a front view of the alternative embodiment of the tire rack 200 having the adjustable rail 210 in the first position, holding the plurality of alternative tires.
Figure 13:
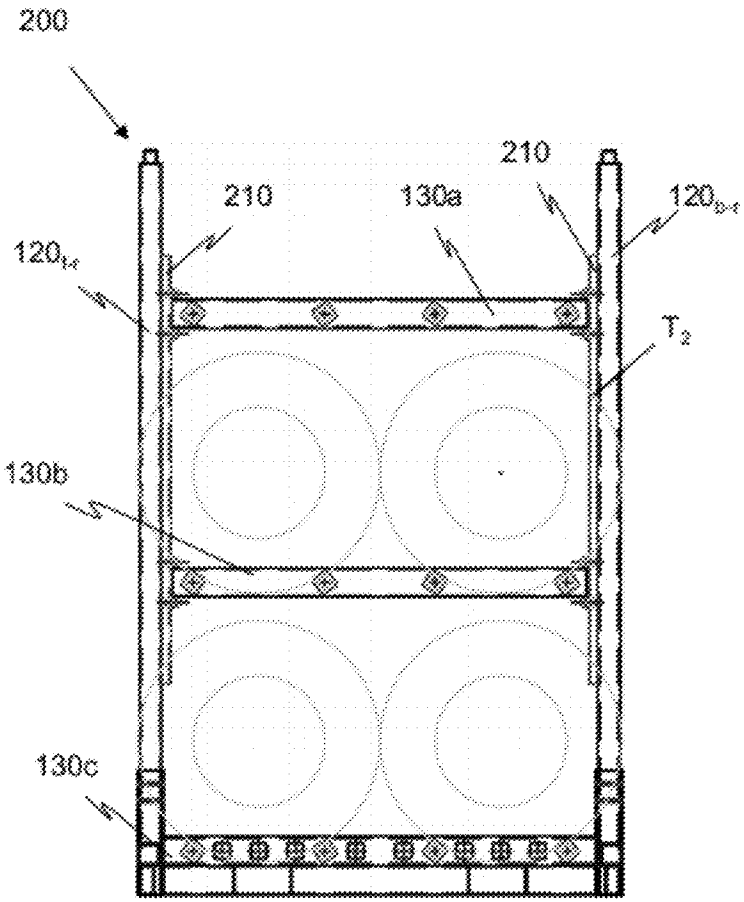
FIG. 13 illustrates a side view of an alternative embodiment of a tire rack 200 having an adjustable rail 210 in a first position, holding a plurality of alternative tires.

FIGS. 13 and 14 illustrate a side view and front view, respectively, of an alternative embodiment of a tire rack 200. The alternative embodiment of the tire rack 200 is substantially the same as the tire rack 100 described above, except for the differences detailed herein. Like reference numerals are used for like components.

In the tire rack 200, an adjustable rail 210 is slidably attached to each of the posts 120 by a plurality of fasteners 220. Exemplary fasteners include bolts and screws. In one particular embodiment, the fasteners 220 are flange bolts having a gripping surface that performs a locking function.

In the illustrated embodiment, fasteners 220 are fixed to the posts 120 and the adjustable rail 210 is moved up or down to a desired height. When the desired height is reached, the fasteners 220 are tightened, thereby fixing the adjustable rail 210 in place. In an alternative embodiment (not shown), the rails 220 have a plurality of detent positions, so the rail may be easily moved to a plurality of desired positions. In another alternative embodiment, the rails 210 have a plurality of apertures (not shown) that can be aligned with the fasteners 220 at a plurality of different heights. In yet another embodiment (not shown), the posts 120 and the rails 220 both have a plurality of corresponding apertures. The corresponding apertures may be aligned at a desired height, and the rail 210 is fixed in place with a fastener that passes through the corresponding apertures.

In the illustrated embodiment, lower side bars 130*c* are directly attached to the posts 120. However, upper side bars 130*a* and middle side bars 130*b* are not directly attached to the posts 120, but are instead attached to the rails 210. The side bars 130*a,b* may be fixedly or removably attached to the rails 210. Further, the side bars 130*a,b* may be directly connected to the rails 210, or they may be connected via intervening connectors.

It should be understood that the rails 210 may be placed at a desired height before the side bars 130*a,b* are attached to the rails 210. Alternatively, the side bars 130*a,b* may be attached to the rails 210 first. In such an embodiment, the side bars 130*a,b* and front and back rails 210 may be moved as a unit. Similarly, the crossbars 150 may also be attached to the side bars 130 prior to adjustment, in which case, the side bars 130*a,b*, crossbars 150, and all rails 210 may be moved as a unit.

In FIGS. 13 and 14, the rails 210 are placed in a first position, holding a plurality of alternative tires $T_2$. The alternative tires $T_2$ have a larger diameter than the tires T illustrated in FIGS. 7, 8, and 10-12. Therefore, the first position is a higher position than the position of the side bars 130 in the embodiment illustrated in FIGS. 1-12, to provide adequate clearance for the tires.

In FIGS. 13 and 14, tires are not held in the upper crossbars 150. The upper crossbars 150 may be left empty to allow an additional tire rack (not shown) to be stacked on top of the tire rack 200. The upper crossbars 150 may also be left empty if the storage space (such as a trailer of a truck) would not accommodate tires placed at this height. However, it should be understood that tires may otherwise be held by the upper crossbars 150.

Figure 16:
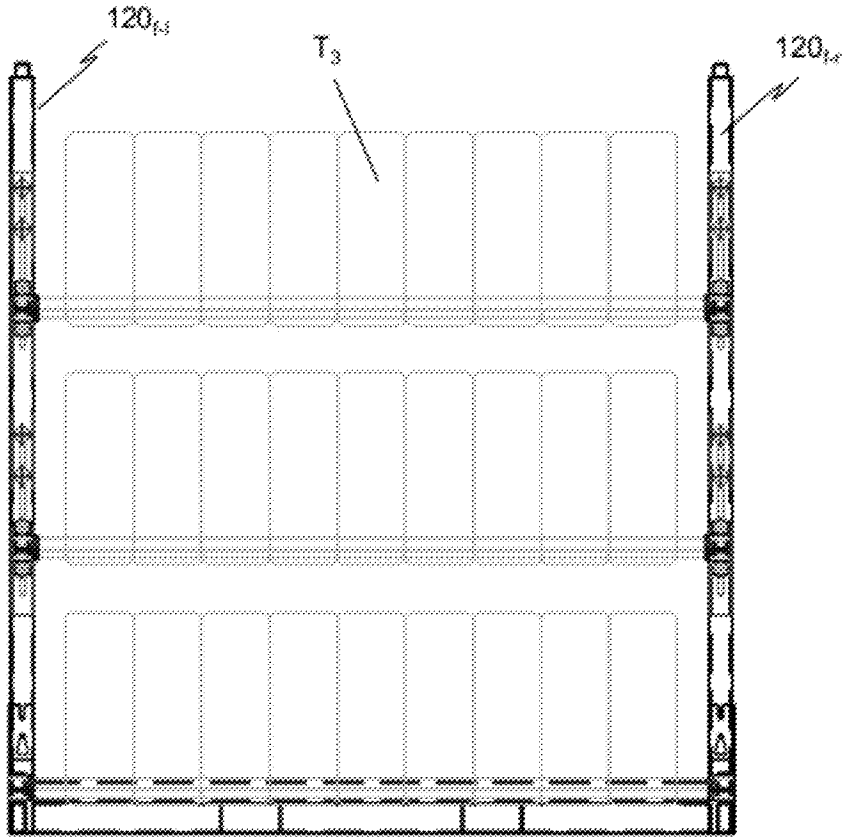
FIG. 16 illustrates a front view of the alternative embodiment of the tire rack 200 having the adjustable rail 210 in the second position, holding the plurality of other alternative tires.
Figure 15:
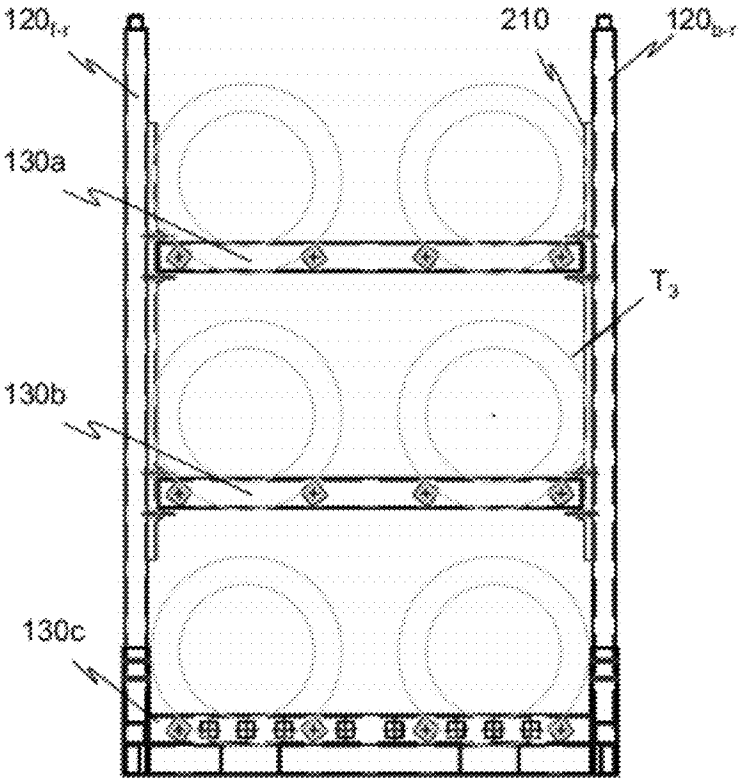
FIG. 15 illustrates a side view of the alternative embodiment of the tire rack 200 having the adjustable rail 210 in a second position, holding a plurality of other alternative tires.

FIGS. 15 and 16 illustrate a side view and front view, respectively, of the alternative embodiment of the tire rack 200 having the adjustable rail 210 in a second position, holding a plurality of other alternative tires $T_3$. These other alternative tires $T_3$ have a diameter that is smaller than the alternative tires $T_2$. Accordingly, the second position is a lower position than the first position. In the illustrated embodiment, all of the crossbars hold tires $T_3$.

Figure 17C:
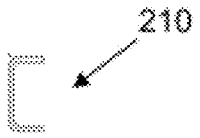
FIGS. 17A-C illustrate side, front, and top views, respectively, of the adjustable rail 210.
Figure 17A:
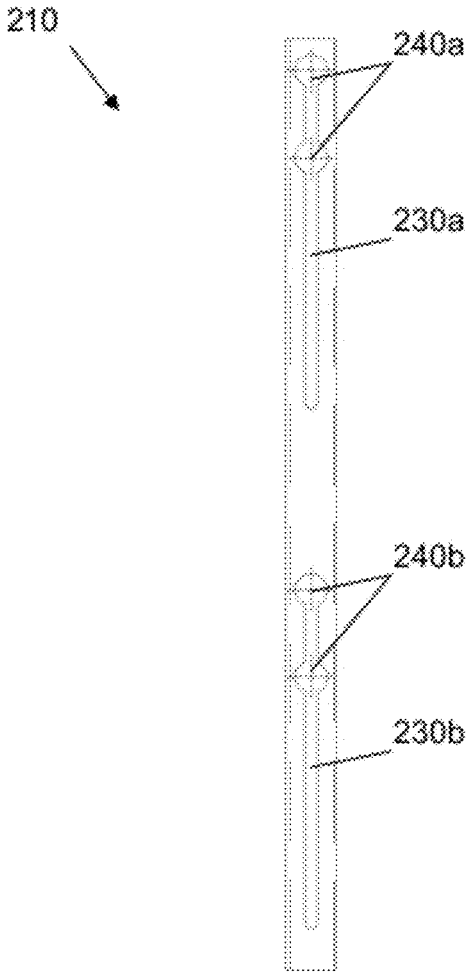
Figure 17B:
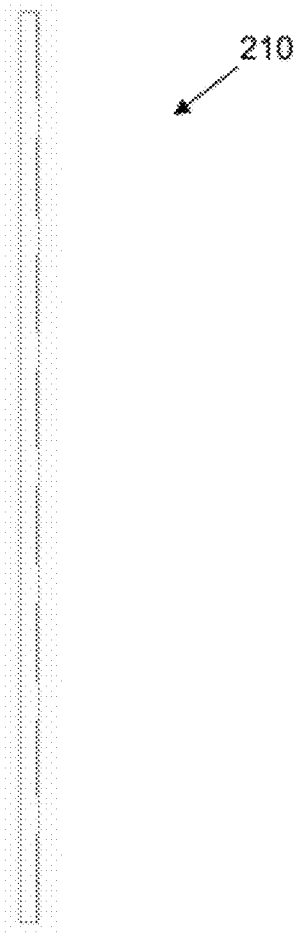

FIGS. 17A-C illustrate side, front, and top views, respectively, of the adjustable rail 210. The rail 210 includes an upper slot 230*a* having a pair of apertures 240*a* and a lower slot 230*b* having a pair of apertures 240*b*. The apertures may be sized to accommodate a head of a fastener 220. In an alternative embodiment (not shown), each slot has a single aperture associated with it. In another alternative embodiment (not shown), each slot has three or more apertures associated with it.

While the apertures 240*a,b* are shown as circular, it should be understood that they may be square, rectangular, or take any geometric shape. Further, while the apertures 240*a,b* are shown as disposed at the top of each slot 230*a,b*, it should be understood that they may be located at any position along the slot.

In one embodiment, the rail 210 is constructed of carbon steel. In alternative embodiments the rail may be constructed of stainless steel, iron, aluminum, or other metals.

In one known embodiment, the rail 210 is formed from sheet stock by laser cutting the slots 230 and apertures 240 and bending the sheet stock in a brake press to form the rail 210. In alternative embodiments, the slots 230 and apertures 240 of the rail 210 may be punched, saw-cut, flame-cut, or plasma-cut. In other alternative embodiments, the rail may be formed by other bending methods or by molding.

Figure 18:
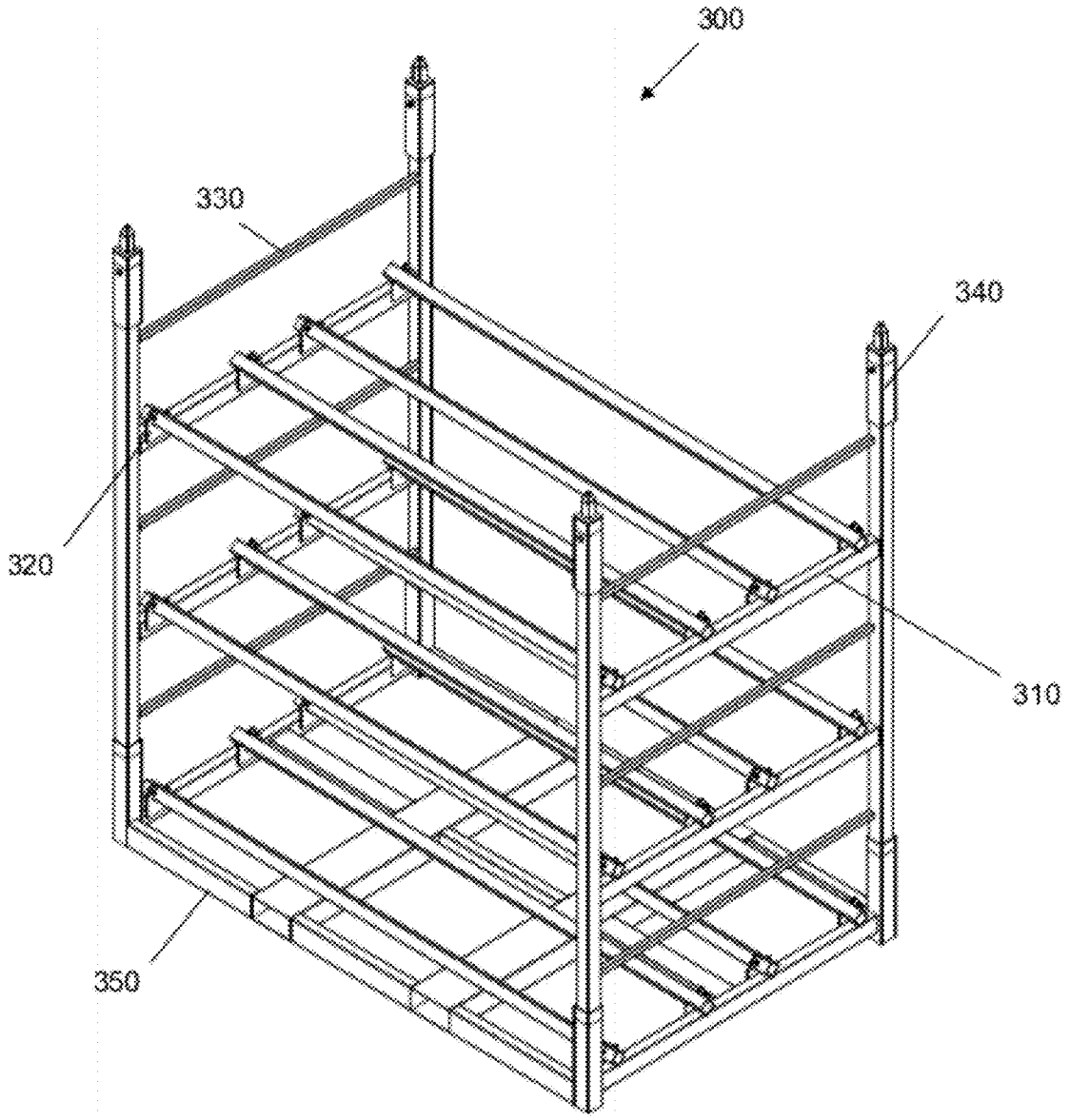
FIG. 18 illustrates a perspective view of another alternative embodiment of a tire rack.

FIG. 18 illustrates a perspective view of another alternative embodiment of a tire rack 300. The alternative embodiment of the tire rack 300 is substantially the same as the tire rack 100 described above, except for the differences detailed herein. Like reference numerals are used for like components.

In the tire rack 300, side bars 310 are solid and do not include apertures. Instead, a plurality of extensions 320 are connected to the side bars. Each of the plurality of extensions 320 includes an aperture configured to receive an end of one of the crossbars 150. The extensions 320 may be welded, bolted, or otherwise affixed to the side bars 320.

In the illustrated embodiment, the aperture of the extension 320 defines an open-ended spanner shape. The aperture if configured to receive the square-shaped crossbar 150. In the illustrated embodiment. The open-ended spanner shape and aperture is laser cut. Alternatively the spanner shape and aperture may be punched, saw-cut, flame-cut, or plasma-cut. The spanner shape may also be forged or molded. In alternative embodiments (not shown) the extension 320 is ring shaped, and the aperture is a hole extending therethrough.

Supportive side bars 330 are also disposed between the side bars 310. In the illustrated embodiment, the supportive side bars 330 are substantially parallel to the side bars 310. In an alternative embodiment (not shown), the supportive side bars are disposed at an acute angle relative to the side bars. In one particular embodiment (not shown), the supportive side bars are criss-crossed.

With continued reference to FIG. 18, the posts 120 further include caps 340.

In the illustrated embodiment, the lower side bars do not include secondary apertures, such as those shown in FIG. 1. However, it should be understood that one or more of the pairs of side bars may include secondary apertures to retain the crossbars during storage or transportation.

The tire rack 300 further includes a base 350. The base 350 is substantially the same as the base 110 of the tire rack 100, except it does not include apertures in the side. Instead, the sides are open. However, it should be understood that the base 110 illustrated above may be employed with this embodiment.

Figure 19:
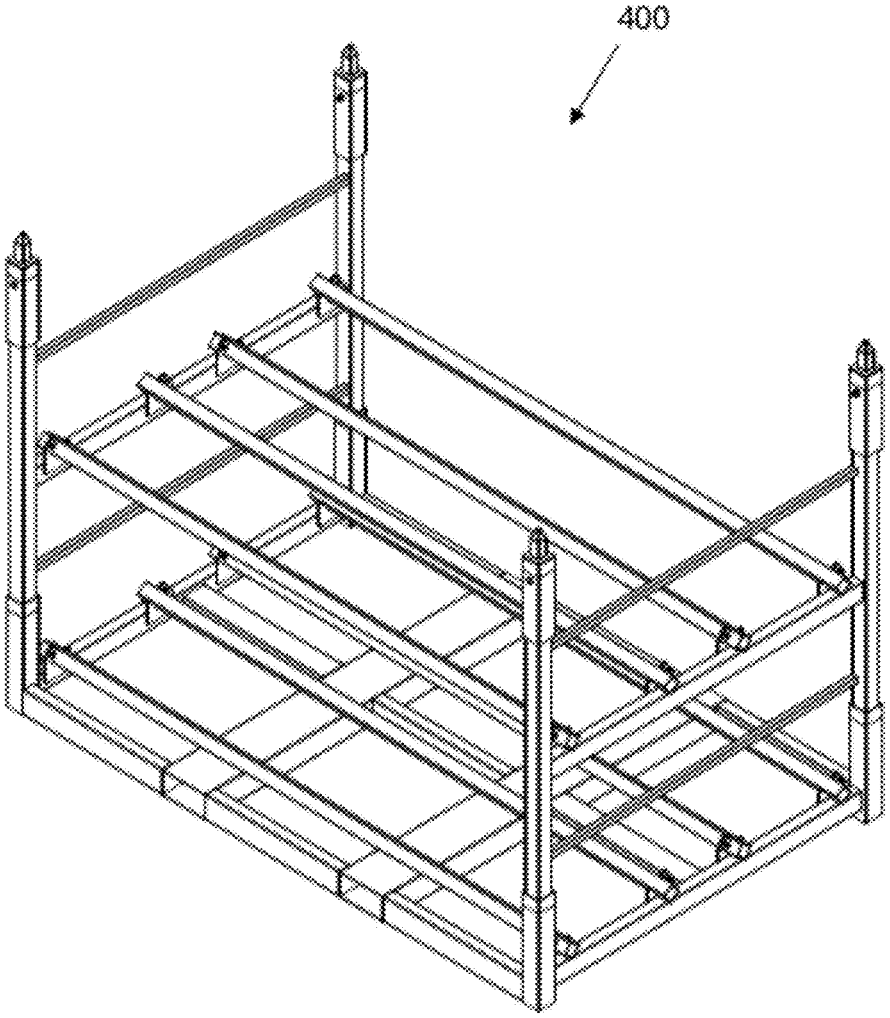
FIG. 19 illustrates a perspective view of yet another alternative embodiment of a tire rack.

FIG. 19 illustrates a perspective view of yet another alternative embodiment of a tire rack 400. The alternative embodiment of the tire rack 400 is substantially the same as the tire rack 300 described above, except it only includes two levels of crossbars instead of three. Such an embodiment may be used as in a stack of racks to account for space limitations. It should be understood that the dimensions of the rack may be altered to account for particular needs.

Figure 20A:
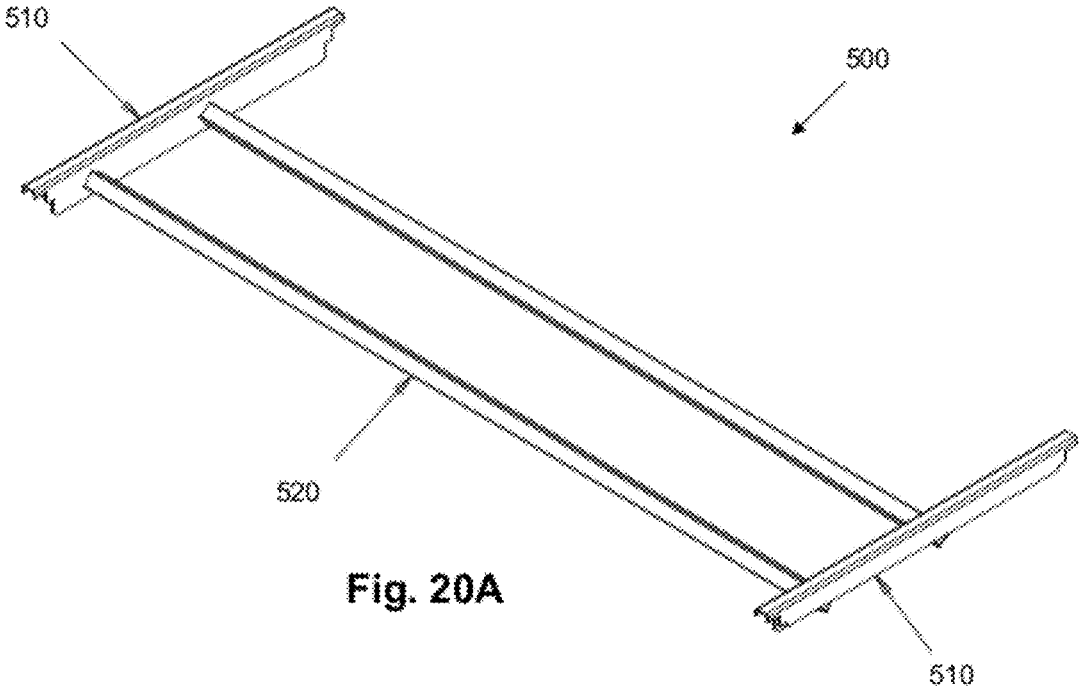
FIGS. 20A-B illustrate perspective and side views, respectively, of an insert for a rack.
Figure 20B:
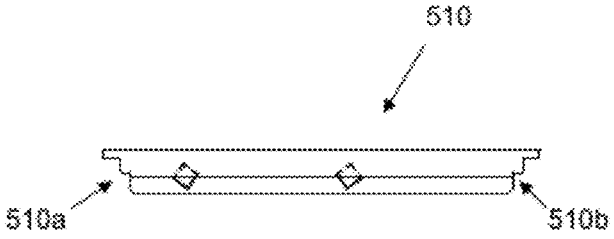

FIGS. 20A-B illustrate perspective and side views, respectively, of an insert 500 for a rack. The insert 500 may be used in a permanent rack or a portable rack. The insert is suitable for fixed racking shelves where seismic regulations may make it difficult to use portable racking. In one particular embodiment, the insert 500 is used in a rack system having at least a pair of front posts, a pair of rear posts, a plurality of front elongated crossbars extending between the pair of front posts, and a pair of rear elongated crossbars extending between the pair of rears posts.

The insert 500 includes a pair of opposing side beams 510. Each side beam 510 has a front, inverted stair-shaped abutment 510*a* and a rear, inverted stair-shaped abutment 510*b*. The insert further includes a pair of elongated crossbeams 520 extending between the opposing side beams.

The elongated crossbeams 520 have substantially rectangular cross sections. Each of the elongated crossbeams 520 is angled to receive a tread of a tire. In one embodiment, the elongated crossbeams 520 are constructed of 2-inch square tubes that are bolted to the side beams 510. In alternative embodiments, the crossbeams may be circular, rectangular, or take any geometric shape. In another alternative embodiment, the crossbeams may be welded or otherwise affixed to the crossbeams. In yet another alternative embodiment, the side beams may have apertures that receive the crossbeams.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A tire rack comprising:

a base having a plurality of apertures in a bottom surface;

a plurality of posts extending from a top surface of the base, each of the plurality of posts having a reduced diameter portion having dimensions corresponding to the apertures in the bottom surface of the base;

a plurality of height adjustable rails slidably coupled to the plurality of posts by a plurality of fasteners, wherein the adjustable rails each comprise a generally keyhole shaped slot, wherein the plurality of fasteners are fixed to the plurality of posts while the height of the plurality of adjustable rails are adjusted, and wherein the plurality of fasteners are configured to be tightened within the generally keyhole shaped slots of the adjustable rails, thereby fixing the height adjustable rails in place after the rails are adjusted;

a plurality of side bars, each side bar coupled to two of the plurality of rails, extending between two of the plurality of posts, and each side bar having a plurality of apertures; and a plurality of crossbars, each crossbar extending between two of the plurality of side bars, wherein each crossbar has a first end removably received in an aperture of a first side bar and a second end removably received in an aperture of a second side bar, wherein the plurality of crossbars are configured to receive a plurality of tires in an upright position.

2. The tire rack of claim 1, wherein each of the plurality of posts includes an upper portion hingedly connected to a lower portion.

3. The tire rack of claim 1, wherein each of the plurality of crossbars has a substantially rectangular cross-section.

4. The tire rack of claim 3, wherein each of the plurality of crossbars is angled to receive a tread of a tire.

5. The tire rack of claim 1, wherein the base further includes a plurality of apertures in a front surface and a back surface.

6. The tire rack of claim 5, wherein each of the plurality of apertures in the front surface and back surface of the base are sized and positioned to receive a fork of a forklift.

7. The tire rack of claim 1, further comprising a second base having a plurality of apertures in a bottom surface and a second plurality of posts extending from a top surface of the second base, wherein each of the plurality of apertures in the bottom surface of the second base receives a reduced diameter portion of one of the plurality of posts extending from the top surface of the base.

8. The tire rack of claim 1, wherein each of the plurality of apertures of the side bars are laser-cut directly in the side bars.

9. The tire rack of claim 1, wherein an opposing pair of the plurality of sidebars includes a plurality of secondary apertures configured to receive the plurality of crossbars in a storage position.

10. A tire rack system comprising:

a first base;

a first plurality of posts extending from a top surface of the first base, each of the plurality of posts having a reduced diameter portion;

a first plurality of height adjustable rails slidably coupled to the first plurality of posts by a first plurality of fasteners, wherein the first plurality of height adjustable rails each comprise a generally keyhole shaped slot, wherein the first plurality of fasteners are fixed to the first plurality of posts while the first plurality of height adjustable rails are adjusted, and wherein the first plurality of fasteners are configured to be tightened within the generally keyhole shaped slots of the first adjustable rails, thereby fixing the first plurality of height adjustable rails in place after the first plurality of rails are adjusted;

a second base having a plurality of apertures in a bottom surface that removably receive the reduced diameter portions of the first plurality of posts;

a second plurality of posts extending from a top surface of the second base; a second plurality of adjustable rails slidably coupled to the second plurality of posts by a second plurality of fasteners, wherein the second plurality of fasteners are fixed to the second plurality of posts while the second plurality of adjustable rails are adjusted, and wherein the second plurality of fasteners are configured to be tightened, thereby fixing the second plurality of adjustable rails in place after the second plurality of rails are adjusted;

a plurality of side bars, each side bar coupled to two of the plurality of rails, extending between two of the plurality of posts, and each side bar having a plurality of apertures; and a plurality of crossbars, each crossbar extending between two of the plurality of side bars, wherein each crossbar has a first end removably received in an aperture of a first side bar and a second end removably received in an aperture of a second side bar, wherein the plurality of crossbars are configured to receive a plurality of tires in an upright position.

11. The tire rack system of claim 10, wherein each of the second plurality of posts has a reduced diameter portion.

12. The tire rack system of claim 11, further comprising a third base having a plurality of apertures in a bottom surface that removably receive the reduced diameter portions of the second plurality of posts.

13. The tire rack system of claim 12, further comprising a third plurality of posts extending from a top surface of the second base.

14. The tire rack system of claim 10, wherein each of the plurality of apertures of the side bars are disposed directly in the side bars.

* * * * *